US007802391B2

(12) United States Patent
Quinn et al.

(10) Patent No.: US 7,802,391 B2
(45) Date of Patent: Sep. 28, 2010

(54) ROUNDS COUNTER REMOTELY LOCATED FROM GUN

(75) Inventors: James P. Quinn, Gurnee, IL (US); Jason L. Seelye, Saint Charles, IL (US); Mark Prichard, Glen Ellyn, IL (US); James T. Dillon, Algonquin, IL (US)

(73) Assignee: EOS Defense Systems, Inc., Tucson, AZ (US)

( * ) Notice: Subject to any disclaimer, the term of this patent is extended or adjusted under 35 U.S.C. 154(b) by 0 days.

(21) Appl. No.: 12/586,211

(22) Filed: Sep. 17, 2009

(65) Prior Publication Data

US 2010/0011943 A1 Jan. 21, 2010

Related U.S. Application Data

(62) Division of application No. 11/805,989, filed on May 24, 2007, now Pat. No. 7,614,333.

(51) Int. Cl.
*F41A 9/62* (2006.01)

(52) U.S. Cl. ..... 42/1.03; 42/1.01; 89/40.01; 89/41.08

(58) Field of Classification Search ..... 42/1.03, 42/1.01; 89/40.01, 41.08
See application file for complete search history.

(56) References Cited

U.S. PATENT DOCUMENTS

| | | | | |
|---|---|---|---|---|
| 3,260,107 | A | 7/1966 | Rosen | 73/167 |
| 3,509,791 | A | 5/1970 | Pechamat et al. | 89/135 |
| 3,914,996 | A | 10/1975 | Davis et al. | 73/167 |
| 4,269,415 | A | 5/1981 | Thorne-Booth | 463/50 |
| 4,480,524 | A | 11/1984 | Blomqvist et al. | 89/41.16 |
| 4,541,191 | A | 9/1985 | Morris et al. | 42/1.01 |
| 4,548,122 | A | 10/1985 | Hansson et al. | 89/37.05 |
| 5,005,307 | A | 4/1991 | Horne et al. | 42/1.02 |
| 5,033,217 | A | 7/1991 | Brennan | 42/1.01 |
| 5,052,138 | A | 10/1991 | Crain | 42/1.02 |
| 5,083,392 | A | 1/1992 | Bookstaber | 42/84 |

(Continued)

OTHER PUBLICATIONS

International Search Report and Written Opinion dated Sep. 2, 2008 in PCT/US 08/06308, filed May 15, 2008.

*Primary Examiner*—Stephen M Johnson
*Assistant Examiner*—Daniel J Troy
(74) *Attorney, Agent, or Firm*—McDonnell Boehnen Hulbert & Berghoff LLP

(57) ABSTRACT

A rounds counter for a weapon mount is disclosed. The rounds counter is mounted on the mount in a remote location from the weapon itself, such as to a pedestal supporting a gimbal rotating the weapon mount in azimuth, inside an elevation drive housing, or to other structure. The mounting location is selected to be one where shock loads are relatively high, as compared to other locations on the mount. The rounds counter includes a sensor which senses shock due to the firing of the weapon, such as an accelerometer or strain gauge. The sensor could also be an acoustic transducer. Analog and digital circuitry for processing the sensor signal and to count the firing of the gun is also disclosed. The rounds counter is particularly useful as a common, single rounds counter unit for a weapon mount is adapted to receive and fire a variety of weapons, such as remotely operated weapon mounts mounted to military vehicles and patrol watercraft adapted to receive and fire four different types of guns.

8 Claims, 7 Drawing Sheets

U.S. PATENT DOCUMENTS 5,142,805 A 9/1992 Horne et al. ..... 42/1.02
5,303,495 A 4/1994 Harthcock ..... 42/84
5,349,853 A 9/1994 Oehler ..... 73/167
5,642,581 A 7/1997 Herold et al. ..... 42/1.02
5,826,360 A 10/1998 Herold et al. ..... 42/1.02
5,918,304 A 6/1999 Gartz ..... 89/1.1
5,947,738 A 9/1999 Muehle et al. ..... 434/16
5,949,015 A 9/1999 Smith et al. ..... 89/41.05
6,769,347 B1 8/2004 Quinn ..... 89/41.05
7,143,644 B2 12/2006 Johnson et al. ..... 73/167
7,158,167 B1 1/2007 Yerazunis et al. ..... 348/61
7,231,862 B1 6/2007 Quinn ..... 89/41.05
7,356,956 B2 4/2008 Schinazi et al. ..... 42/1.01
2002/0174588 A1 11/2002 Danner et al. ..... 42/70.09
2004/0050240 A1 3/2004 Greene et al. ..... 89/41.06
2004/0200109 A1 10/2004 Vasquez ..... 42/1.01
2005/0114084 A1 5/2005 Johnson et al. ..... 702/183

ROUNDS COUNTER REMOTELY LOCATED FROM GUN

PRIORITY

This is a divisional of U.S. application Ser. No. 11/805,989 filed May 24, 2007, pending, the contents of which are incorporated by reference herein.

STATEMENT REGARDING FEDERALLY SPONSORED RESEARCH OR DEVELOPMENT

Not applicable.

BACKGROUND OF THE INVENTION

A. Field of the Invention

This invention relates generally to the field of weapon systems and more particularly to a counter counting the number of rounds fired by a gun. The rounds counter is positioned remote from the gun. The rounds counter is particularly useful for gun mounts adapted to receive and fire a variety of different guns.

B. Description of Related Art

A remotely operated weapon station, such as the RAVEN™ stabilized remote weapons station produced by Recon Optical, Inc. is described in U.S. Pat. No. 6,769,347, the content of which is incorporated by reference herein. Other prior art of interest in the area of remotely operated weapon systems includes U.S. Pat. No. 5,949,015, the content of which is incorporated by reference herein.

These patents are directed to a weapon station that provides the capability to mount, remotely aim, and remotely fire a suite of crew served weapons. The weapon station is usually operated from inside an armored vehicle to which the weapon station is attached, and may also provide a capability for manual, local operation of the gun, e.g., in the event of a power failure. The weapon station is capable of mounting on a variety of vehicles, such as trucks, armored personnel carriers, high mobility multi-purpose vehicles commonly known as HUMVEEs, and military and police watercraft. The weapon station is powered by the host vehicle system power. The weapon mount may optionally be stabilized to remove vehicle motion from the weapon aimpoint. The weapon station consists of a mount having azimuth and elevation drives, weapon interface, viewing and sighting unit, remote control and display unit, and electronics support unit with fire control processor. Some weapon stations such as the Recon Optical RAVEN™ may offer additional features including optional weapon cradles, weapon remote firing capability, weapon remote charging capability, and an ammunition/magazine feed system.

Remote weapon stations rely on associated ammunition containers mounted on or near the weapon mount to supply the weapon used with rounds of ammunition. Since the weapon station is operated remotely from a control and display unit, the gunner/operator is not located near the weapon or the associated ammunition container. Therefore, the amount of ammunition remaining in the container after weapon firing sequences is not directly observable by the gunner/operator.

A means of having the system count the number of rounds fired and more importantly, the number of rounds remaining in the ammunition container, is important to the gunner-operator and a key performance parameter of a remote weapon station. Ammunition rounds counting mechanisms currently used in association with remote weapon stations typically allow the operator to enter the number of rounds loaded into the ammunition container, are able to count down from the total number of rounds loaded/entered, and display the number of rounds remaining for weapon firing.

Prior art references related to devices for detecting the firing of rounds from a gun in include the following references: Yerazunis et al., U.S. Pat. No. 7,158,167; Johnson et al., U.S. Pat. Nos. 7,143,644 and 7,100,437; Wright, Sr. et al., U.S. Pat. No. 5,799,432; Brinkley et al., U.S. Pat. No. 5,566,486; Brennan, U.S. Pat. No. 5,033,217; Hartcock, U.S. Pat. No. 5,303,495 and Sayre, U.S. Pat. No. 5,406,730. These references disclose the use of a variety of different technologies to detect the firing of a round, including recoil and sound transducers, proximity sensors, Hall-effect sensors and accelerometers. The sensor is typically mounted to the barrel of the gun (as in the Johnson et al. '644 patent) or elsewhere on the gun itself, e.g., in the handgrip.

With weapon mounts that are configured to fire a variety of different guns, one prior art approach to rounds counting is to provide each gun with its own rounds counters, the rounds counter mounted to the gun as in the above prior art. Some rounds counting mechanisms of the present art employ a slide switch which is activated by the action of the weapon bolt or round activating/loading/ejecting mechanism to record the weapon firing event by switch closure. Other rounds counters utilize an inductive proximity sensor that senses the presence of a metal brought within 2 mm of the active surface of the sensor, such as the movement of a weapon bolt or round activating/loading ejecting mechanism into the vicinity of the proximity of the sensor. Therefore, the location of the proximity sensor may be different for each weapon type used. For example, the M2 50 cal. machine gun locates the proximity sensor so the weapon bolt passes its active surface as it recoils. This implementation results in two events recorded for each shot fired. Other smaller caliber machine guns place the sensor near the feed port to again sense the bolt action. This can result in two or four events per cycle. A Mk19 grenade machine gun places the sensor in the feed mechanism to sense the front of the projectile, resulting in 1 event per round. In all the above cases, the rounds counting sensing mechanisms are located on the weapon or at the location of the weapon.

The difference in output signals resulting from the use of a proximity sensor with various weapons requires additional hardware and or software to be incorporated within the weapon system. Clearly, this is a disadvantage. For example, in one prior art gun, the proximity sensing scheme is made viable by using software to read the output of the proximity sensor 4000 times per second while the weapon trigger is active. The software therefore further qualifies the output by allowing only one count per given time period due to the multiple events per round. With other weapons, a completely different rounds counter arrangement is required. In order to accommodate all the possible rounds counters arrangements, each of which tends to be unique to a particular gun, more complex processing software and hardware is required. When additional gun capabilities are added to the gun mount, still further complexities arise. In short, the present situation is unsatisfactory in at least the following respects: 1) There is a high cost due to many parts needed to produce separate assemblies for each different weapon which is to be mounted to the mount (four in several current systems). 2) There is a need to measure and adjust each switch in order to count the rounds correctly. The adjustment could need to be checked and re-adjusted over the life of the unit. A separate adjustment tool is needed for each rounds counter. 3) Four different rounds counter assemblies are required to accommodate the four different weapons. 4) Multiple cables are needed to route data from each rounds counter assembly, mounted at the weapon, to the electronics unit for the weapon mount.

This invention provides for a common, single rounds counter arrangement that provides a count of the number of rounds that are fired by any gun that may be mounted to the weapon mount. The rounds counter achieves this goal because it is not physically attached to or part of the gun per se, or its ammunition feed supply, as in the prior art, but rather is mounted in a remote location, thereby overcoming the above-described problems and complexities. It has the at least the following advantages: 1) It is much cheaper to produce. 2) No adjustments are needed, and it does not need mechanical adjustment tools. 3) It is easily mounted in the weapon mount (e.g., in the pedestal of the mount) and not to each specific weapon. It is therefore gun mount specific, instead of weapon specific. 4) It has no moving parts, and has much less chance of problems in the field than current devices. 5) The design is reliable, and at least from a mechanical aspect, a more reliable way of rounds counting.

SUMMARY OF THE INVENTION

In a first aspect, the invention provides for gunnery apparatus comprising, in combination a remotely operated weapon mount adapted to receive and fire at least one type of weapon and a rounds counter. The rounds counter includes a sensor for sensing shock imparted to the weapon mount from the firing of the weapon and generating a sensor signal. The sensor is mounted to the weapon mount in a location remote from the weapon. The apparatus further includes electronic circuitry receiving the sensor signal and generating a count of each firing of the weapon.

In one embodiment, the sensor takes the form of least one accelerometer. In other configurations, the sensor may take the form of a strain gauge. The term "strain gauge" is intended to encompass any known device for detecting and measuring stress or strain imparted to a material.

In one possible configuration, the electronic-circuitry receives a trigger signal from a trigger associated with the weapon. The electronic circuitry further comprises a logic element (e.g., AND gate) receiving as input the trigger signal and digital signal obtained from the sensor signal. The logic element produces an output signal which is used by software operating in the electronic circuitry to detect a firing of the weapon and register a count.

In another possible configuration, the electronics circuitry includes an analog circuit module. This module in part functions as a modified peak detector and includes a) a first amplifier receiving a signal (e.g., charge or voltage) from the sensor and outputting a voltage signal, b) a rectifier rectifying the voltage signal output of the first amplifier, c) a filter coupled to the output of the first amplifier to peak detect and hold (stretch) the voltage signal to facilitate detection of short duration sensor signals by the processing electronics circuitry, and d) a second amplifier coupled to the filter buffering the filter output and providing amplification of the voltage output of the first amplifier.

In another embodiment, the electronics circuitry includes a digital electronics module including a) an analog to digital converter (ADC) receiving an analog voltage signal from the analog electronics module, the ADC having a digital output signal; b) a logic gate having as inputs the output of the ADC and a trigger signal from a trigger associated with the weapon; and c) a digital signal processor module. The digital signal processor module including a processor element and a memory storing software instructions for registering a count of weapon firing using the digital output signal from the ADC, the trigger signal, and the output of the logic gate.

The weapon mount for use with the rounds counter can take a variety of forms. In one configuration, the mount is part of a remotely operated weapon station which is adaptable to receive and fire at least two different weapons (or even four or more different types of weapons). The rounds counter of the present invention provides a common rounds counter for all the weapons for use with the weapon station.

The mounting location of the rounds counter sensor to the mount can vary. In one embodiment, the mount includes a pedestal, a gimbal supported by the pedestal, and a weapon cradle for receiving the weapon. The rounds counter sensor is mounted to the pedestal or to structure within the pedestal. In other embodiments, the rounds counter sensor is mounted to an elevation drive used for elevation of the weapon.

In another aspect of the invention, a rounds counter for a weapon mount is provided. The rounds counter includes a) a sensor for sensing shock imparted to the weapon mount from the firing of a weapon held by the weapon mount and generating a sensor signal, wherein the sensor is mounted to the weapon mount in a location remote from the weapon, and b) electronic circuitry receiving the sensor signal and generating a count of each firing of the weapon. The electronic circuitry includes 1) analog circuitry coupled to the sensor and generating an output analog signal; 2) digital circuitry including an analog to digital converter receiving the output analog signal and generating a digital rounds counter signal, the digital circuitry including an input receiving a digital trigger signal from a trigger associated with the weapon mount, and 3) a memory storing program instructions. The instructions include instructions for i) detecting activation of the trigger from the digital trigger signal; ii) detecting a "low" digital rounds counter signal; iii) detecting a "high" digital rounds counter signal; and iv) generating a count after detecting items i), ii) and iii).

In still another aspect of the invention, a method for counting rounds fired by a weapon carried by a weapon mount is disclosed. The method comprising the steps of: mounting a shock-sensing sensor to the weapon mount in a location remote from the weapon; generating a signal by the sensor upon firing of the weapon due to shock imparted to the weapon mount; and processing the signal with electronic circuitry and responsively generating a count of the firing of the weapon. In one embodiment of the method, the weapon mount is adapted to receive and fire at least two different weapons and the rounds counter of the present invention provides a common rounds counter for the weapon mount for the firing of all the different weapons.

The method may further include the steps of receiving a trigger signal indicating activation of a trigger associated with the mounted weapon and using the trigger signal in conjunction with the signal generated by the sensor to generate a count of the firing of the weapon.

In still another aspect, a method for manufacturing a remotely operated weapon mount adapted to receive and fire at least one weapon is disclosed. The method includes the steps of a) determining at least one location on the weapon mount remote from the weapon where shock loads due to the firing of the weapon are high relative to adjacent locations on the weapon mount; and b) mounting a rounds counter at the location determined in step a), the rounds counter comprising a sensor of shocks imparted to the weapon mount due to firing of the weapon.

The location determined in step a) can be experimentally determined from a physical embodiment of the weapon mount, such as for example by mounting an accelerometer to the weapon mount and imparting shocks to the weapon mount, e.g., from firing of the weapon or simulating the firing using other means. In other embodiments, the location determined in step a) is determined from a finite element analysis of the weapon mount (e.g., using a computer model of the weapon mount) and simulation of shock loads due to firing of the weapon. The location can also be identified from both physical testing and finite element analysis.

In a further aspect of the invention, a remotely operated weapon system is disclosed. The weapon system includes a weapon mount adapted to receive and fire more than one type of weapon. The weapon mount includes a pedestal, a gimbal supported by the pedestal, and a weapon cradle coupled to the gimbal. The system further includes a sighting system coupled to the weapon mount, operator controls for the weapon mount located remote from the weapon mount, and a rounds counter providing a common rounds counter for all of the types of weapons received and fired by the weapon mount. The rounds counter is mounted to the mount in location remote from the weapon. The rounds counter takes the form of a sensor, such as an accelerometer, for sensing shocks imparted to the mount due to firing of the weapon.

These and other aspects of the inventive ammunition container will be explained in greater detail in the following description and with reference to the appended drawing figures.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

The illustrated embodiment of a rounds counter was developed for a specific type of weapon mount, namely the stabilized, remotely-operated weapon mount of the assignee Recon Optical, Inc. This weapon mount allows different guns to be affixed to the mount so as to fire a variety of weapons, including .50 caliber rounds, 40 mm grenades, and 5.56 and 7.62 mm machine gun rounds. The principles of the invention are applicable to other types of weapon mounts, including, of course, functionally similar and competitive mounts to the mounts of the Assignee, and other types of rounds. The explanation of the preferred embodiment provided herein, and the application to a stabilized, remotely operated weapon mount, and to particular caliber and type of rounds is offered by way of example and not limitation. The rounds counter can be of course used for other types of mounts and other types and calibers of rounds, and to mounts which are adapted to receive only one type of gun and fire one type of round, mounts adapted to receive two or more guns, and to non-stabilized mounts. All questions concerning scope of the invention are to be answered by reference to the appended claims.

Figure 1:
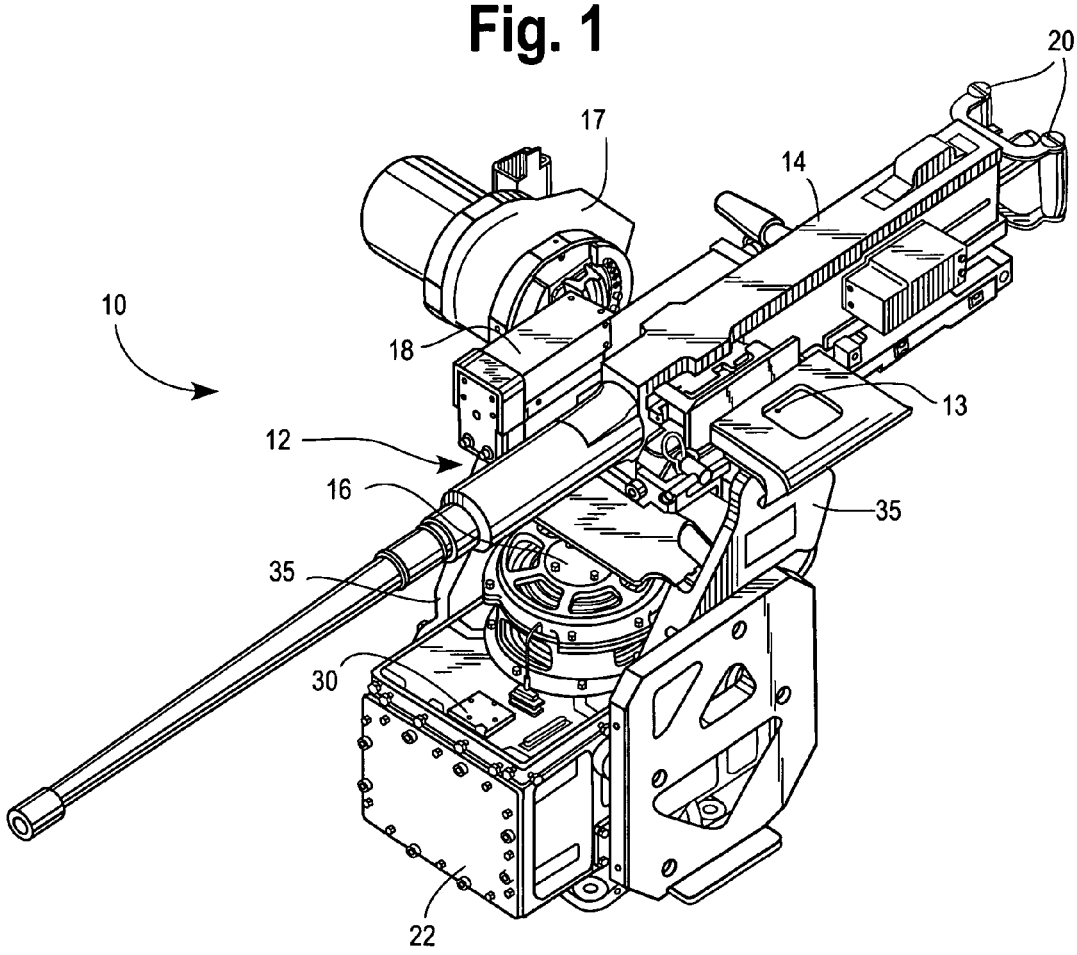
FIG. 1 is a perspective view of a gun mount having a rounds counter module which is mounted remote from the gun itself, in this case to the pedestal for the mount. The rounds counter module includes a shock-sensing sensor such as an accelerometer, group of accelerometers, a strain or stress gauge, or an acoustic shock wave sensor.

FIG. 1 is a perspective view of a remotely operated gun mount system 10 consisting of a weapon mount 12, a weapon cradle 13 for holding a weapon and the weapon (gun) 14. The mount 12 is designed to hold and fire a variety of different guns 14, such as a gun for firing .50 caliber rounds, a gun for firing 40 mm grenades, a gun for firing 5.56 mm machine gun rounds, and a gun for firing 7.62 mm machine gun rounds. The mount 12 further includes other details which are not particularly important, including an azimuth gimbal 16 for rotating the weapon mount 12 in azimuth, an elevation drive 17 for rotating the weapon mount 12 in elevation, a weapon charger 18, a sighting system (not shown), hand controls 20 for operating the weapon in a local mode, and a main pedestal 22 supporting the azimuth gimbal 16 and housing the azimuth drive components (not shown). The weapon mount system 10 includes a remote operator unit including display of imagery captured by the sighting system and a target reticle or aim point of the gun 14, and weapon firing controls, which are not shown in FIG. 1. In the example of the mount of FIG. 1 attached to a military vehicle, the remote operator unit is placed within the interior of the vehicle to protect the operator from enemy fire.

The weapon mount system 10 also includes a rounds counter module 30 which is mounted remote from the gun 14 per se, and in this embodiment is mounted to the pedestal 22. The rounds counter 30 operates by detecting shocks (accelerations) imparted to the mount 12 when the gun 14 is fired, as will be explained below. The rounds counter module 30 could alternatively operate by detecting strain or stress on the pedestal 22 due to gun firing using a strain gauge. Alternatively, the rounds counter module 30 could use an acoustic transducer sensor that operates to detect acoustic pressure from the sound wave emitted when the weapon is fired. Acoustic shock waves can be translated to motion in the pedestal by modal resonance and therefore contribute to the shock signal sensed by an accelerometer sensor (52 in FIG. 2) in the rounds counter module 30.

The mounting location for the rounds counter module 30 is a matter of choice and may vary depending on the design of the mount, its materials, manufacturing methodology (casting versus welded components) and shock characteristics when the gun is fired. The location to mount the module 30 is preferably chosen to have all of the following characteristics: a) shock values (i.e., accelerations) due to weapon firing are high; (b) the location presents a relative ease for mounting the rounds counter module 30; (c) the mounting location provides protection from the environment, such as dust, rain and enemy fire; and (d) the location does not interfere with the weapon functionality or operation, changing of guns, reloading of the ammunition container, or other operational details. The rounds counter module 30 could be located in other locations on the mount 12 depending on available space and other considerations, such as within the housing of elevation drive 17.

The location where shock values are high (and thus a potential location for mounting of the module 30) can be determined experimentally, e.g., by mounting an accelerometer to the pedestal (or elsewhere on the mount), imparting a shock load to the mount by firing the weapon (or by other means to simulate firing), and measuring accelerations at different locations. Alternatively, the location where shock values are high could be determined using a computer and finite element analysis of a computer model of the mount 12 and simulation of shock loads to the model resulting from a simulated firing of the gun. The location can also be determined by combining both a finite element analysis of the mount 12 and physical testing of a mount 12.

Figure 1A:
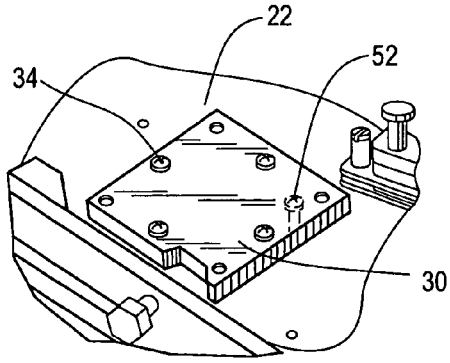
FIG. 1A is a detailed view of the rounds counter module of FIG. 1.
Figure 1B:
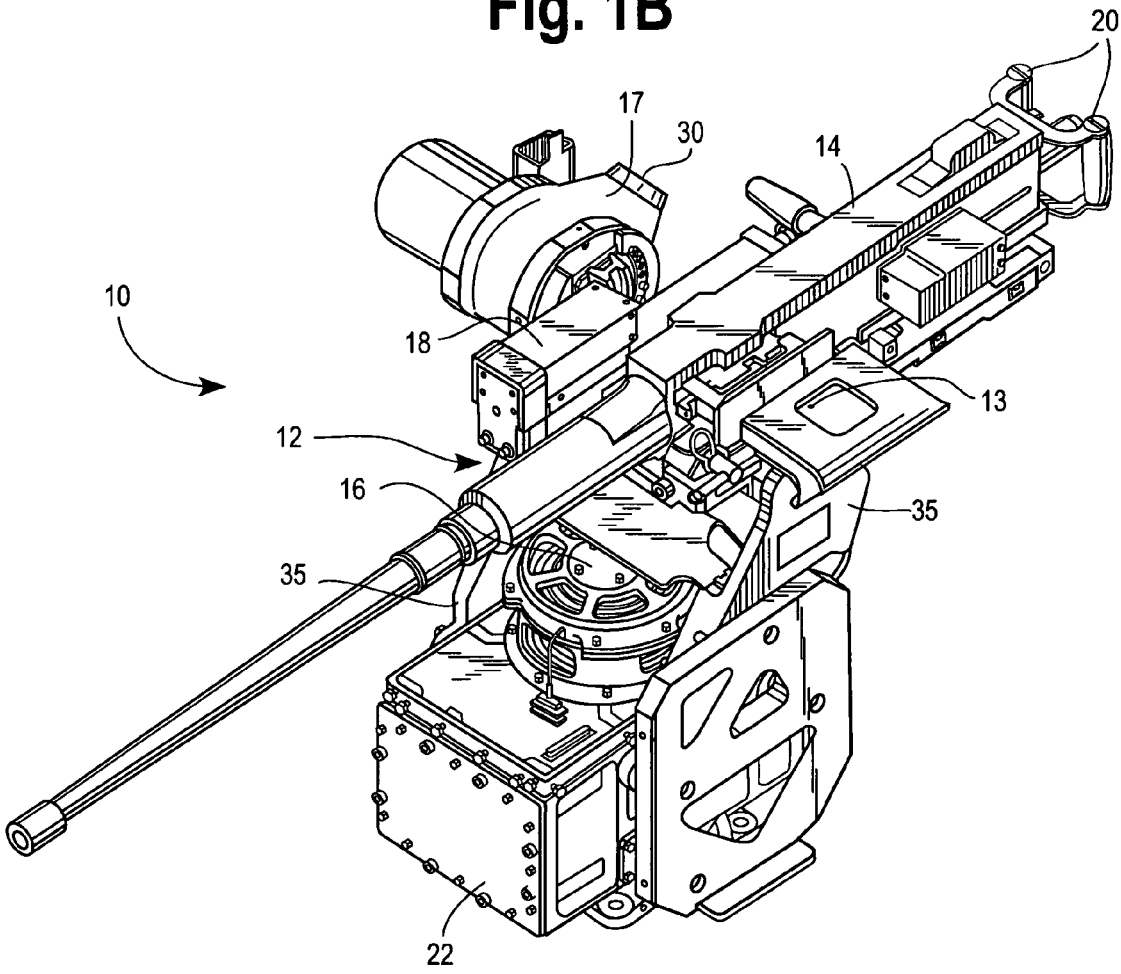
FIGS. 1B, 1C and 1D show different possible mounting locations for the rounds counter of FIGS. 1 and 1A, with the rounds counter mounted to the elevation drive in FIG. 1B, the weapon cradle in FIG. 1C, and to structure within the pedestal in FIG. 1D.
Figure 1C:
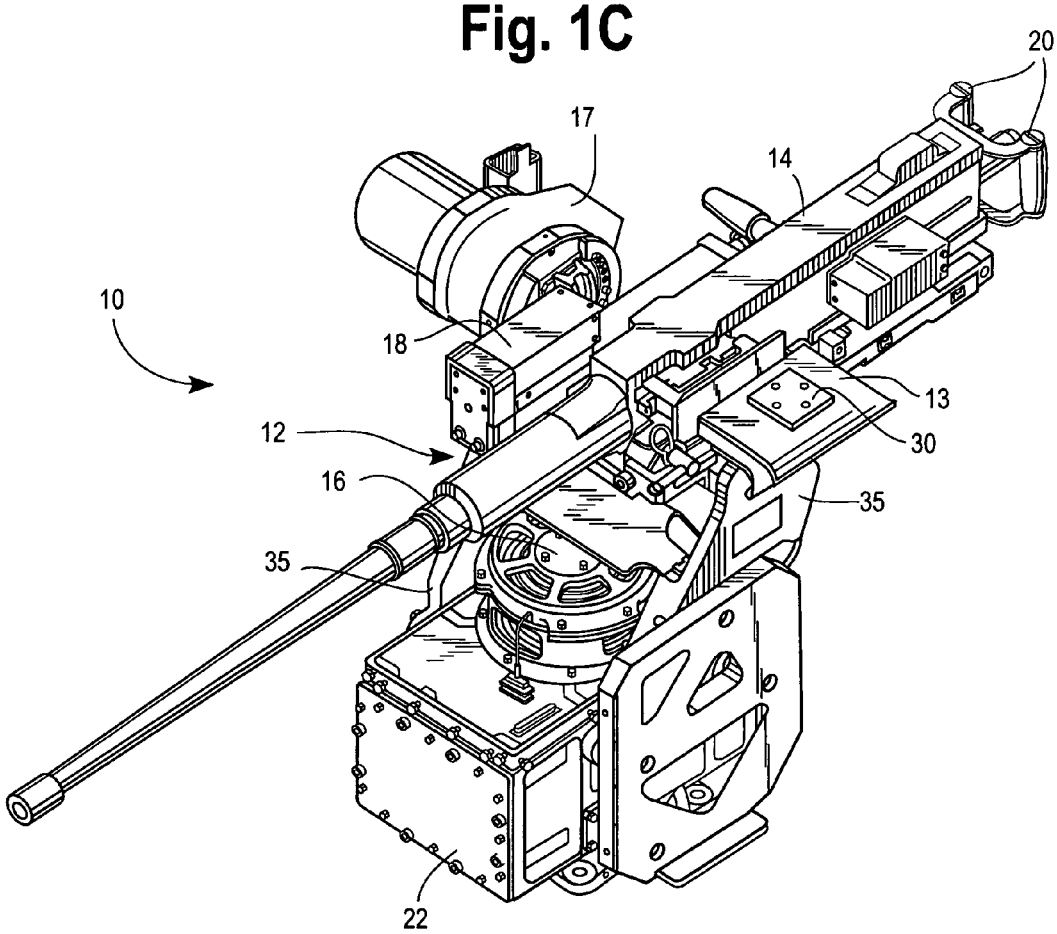
Figure 1D:
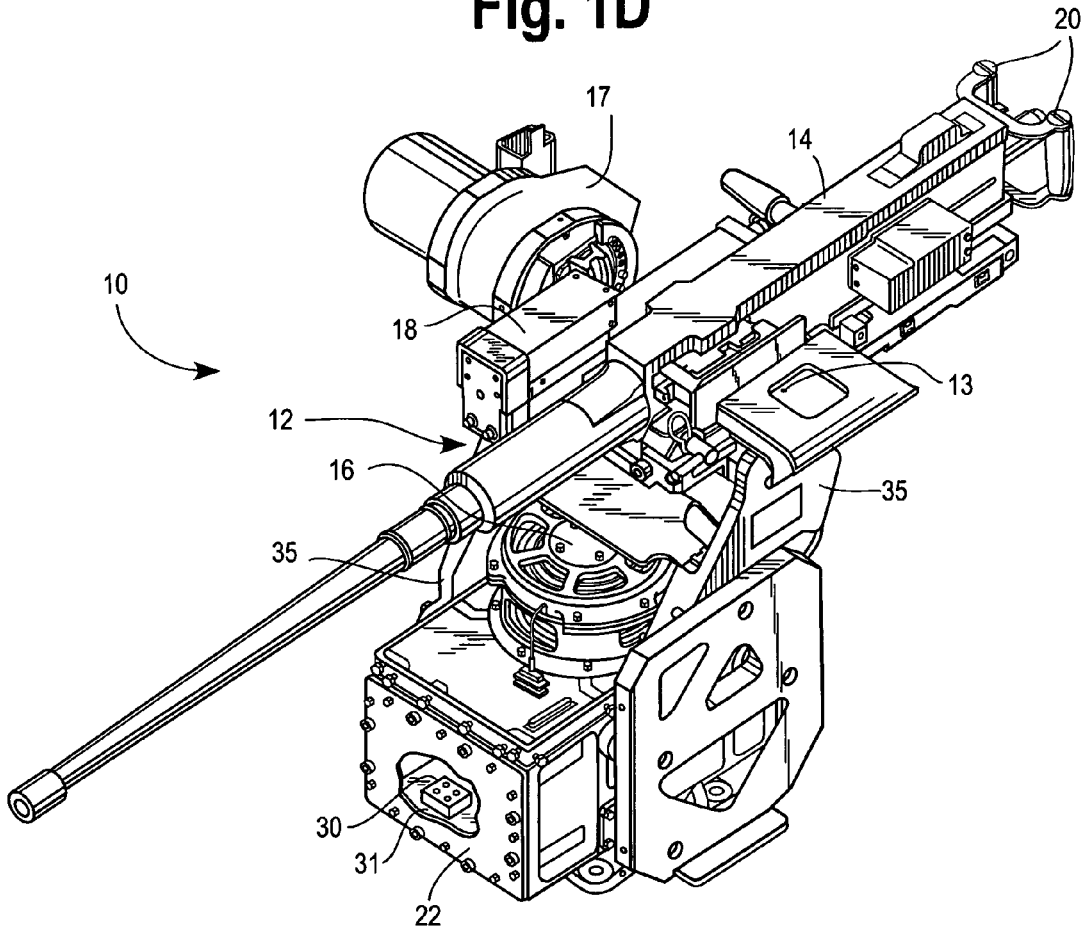

In view of the above description, FIGS. 1B, 1C and 1D show different possible mounting locations for the rounds counter 30 of FIGS. 1 and 1A, with the rounds counter mounted to the elevation drive 17 in FIG. 1B, the weapon cradle 13 in FIG. 1C, and to structure within the pedestal 22 in FIG. 1D, e.g., the floor 31 of the pedestal 22.

The rounds counter module 30 in the embodiment of FIG. 1 includes at least one accelerometer (52, FIG. 2) detecting accelerations. The accelerometer orientation in the embodiment of FIG. 1 is oriented in the vertical direction, since the embodiment shown happened to exhibit high accelerations in the vertical direction. Other configurations for the accelerometer are also possible, including two or three mutually orthogonal accelerometers (e.g., a tri-axial accelerometer) and a two or three-phase rectification circuit for combining the output of a two or tri-axial accelerometer.

The illustrated embodiment of the rounds counter module 30 also includes some pre-processing analog circuitry which functions as a modified peak detector including a first amplifier configured as a charge amplifier, a rectifier, a filter (RC filter in the illustrated embodiment), and a second amplifier configured as an amplifier/buffer which provides an analog (voltage) output signal. The analog acceleration output signal output of the rounds counter module 30 is provided to a digital electronics module including an analog to digital converter and digital signal processor. The digital electronics module is located within the pedestal 22 for the mount 10, but could of course be elsewhere. The analog and digital electronics modules will be explained in further detail below in conjunction with FIGS. 2 and 3. Other arrangements for the distribution of electronics for the rounds counter are of course possible and the invention is not limited to any particular arrangement or distribution of electronic circuits, whether digital or analog.

With reference to the detailed view of FIG. 1A, the rounds counter module 30 is secured to the pedestal with suitable fasteners 34. The accelerometer sensor 52 in the rounds counter module 30 therefore operates and is remotely located from the weapon or gun 14. A ballistics protective cover plate (not shown) is placed over the rounds counter module 30 to protect the rounds counter from the environment.

The illustrated embodiment of the rounds counter module 30 includes an accelerometer sensor that is placed at an optimal location on the weapon mount pedestal 22 to sense the motion generated by the discharge of the weapon. This feature results in an improvement over the prior art, since the module 30 is now mounted internal to the weapon mount and therefore requires no external cable to convey signal from the weapon location (cradle 13 for the weapon 14) to the pedestal 22. Additionally, the present invention is an improvement over the prior art since it utilizes the same rounds counter module 30 for all weapon types which may be mounted to the mount 12. In other words, the rounds counter module 30 is common for all guns 14 mounted to the mount 10. This solves the problem contained in the prior art which requires different sensor modules having different mechanical interfaces for each type of weapon.

The rounds counter module 30 utilizes an accelerometer (or alternatively a strain/stress sensing device or acoustic sensor) as the device which is activated by the shock wave resulting from the weapon being fired to count the number of times the weapon fires and therefore the number of ammunition rounds expended. Finite element analysis of the mount 12 structure in conjunction with dynamic measurements made while firing the weapon will serve to identify one or more high stress points, which are optimal places for mounting the rounds counter module 30. In the embodiment of FIG. 1, a high stress point on the top of the pedestal 22 cube near the front attachment point of the arms 35 was identified. Since the shock level at this point was of very short duration and far in excess of any environment-produced accelerations, other than the powder in the round exploding, it was reasoned that sensing of shock load at this point with an accelerometer or other strain/stress sensing device could effectively count recoils from the weapon, and therefore count rounds. Since this type of sensing device would be internal to the pedestal 22, it works for all weapons and requires no adjustment, therefore solving the several problems with the proximity sensor design.

System Block Diagram

Figure 2:
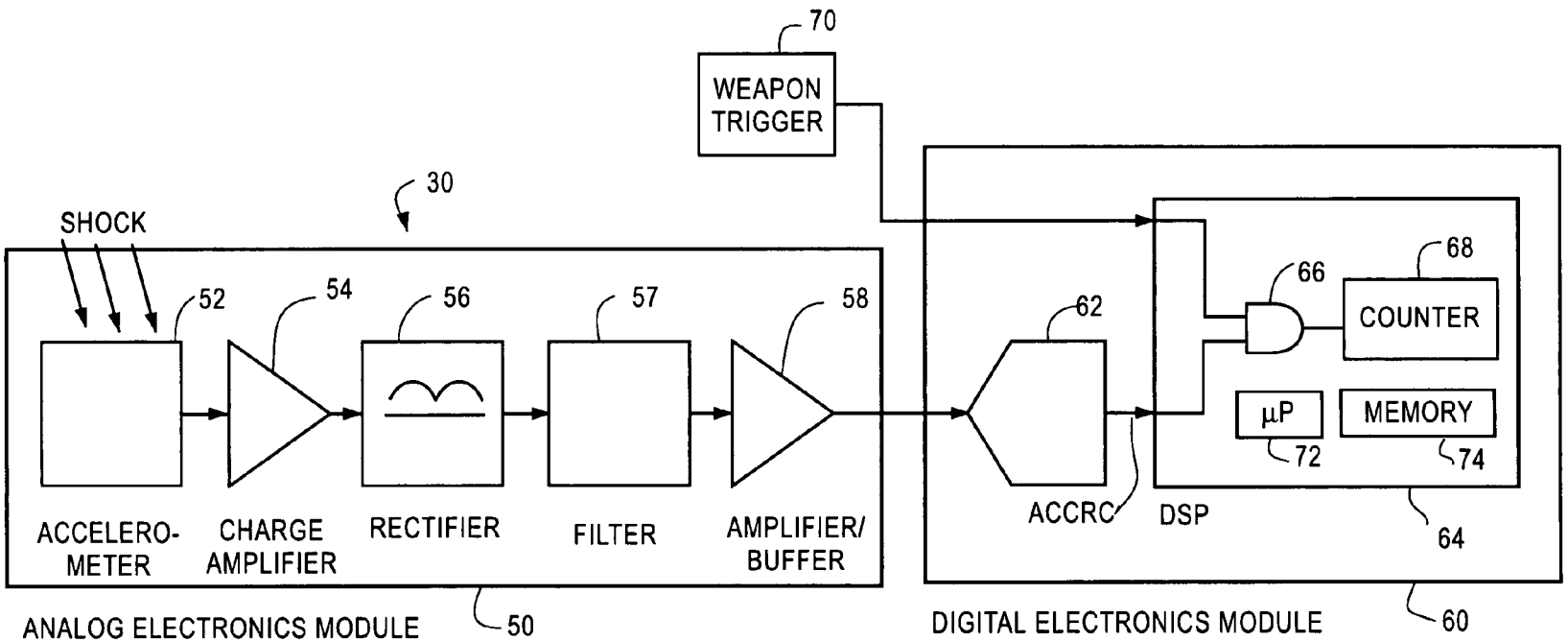
FIG. 2 is a block diagram of the electronics which are used for processing the signal produced by the sensor in the rounds counter module of FIG. 1.

A block diagram of the rounds counter of the preferred embodiment is shown in FIG. 2. The rounds counter includes the components of the rounds counter module 30, which includes an analog electronics module 50. The analog electronics module 50 includes the accelerometer 52, which produces a charge output signal proportional to shocks that are measured by the device, a modified peak signal detector comprising a charge amplifier 54 for amplifying the charge signal from the accelerometer 52 and converting the charge to voltage, a rectifier 56 rectifying the voltage signal output of the charge amplifier, a filter 57 in conjunction with the rectifier reducing the bandwidth, detecting and holding the peak signal voltage value and allowing it to decay slowly (essentially stretching the voltage signal time-wise) to facilitate detection of short duration sensor signals by the processing electronics circuitry, and an amplifier/buffer 58 coupled to the circuitry providing buffering to filter 57 and amplification of the voltage output of the charge amplifier 54.

The analog accelerometer output signal from the amplifier/buffer 58 is supplied to a digital electronics module 60. This module 60 includes an analog to digital converter 62 converting the analog signal to a digital signal and a digital signal processor (DSP) card 64 including an AND gate 66, counter 68, DSP microprocessor 72, memory 74 storing software instructions and a clock (not shown). There are two inputs to the DSP card 64, the digital output from the ADC 62 and a digital trigger signal produced by the weapon mount trigger 70. The signal produced by the trigger 70 indicates whether or not the gunner operating the weapon station is currently pulling the trigger firing the gun mounted to the mount. The inputs to the AND gate 66 are the trigger signal and the digital signal from the ADC 62 as shown in FIG. 2.

The circuitry of FIG. 2 will be of the same general design regardless of the type of shock sensor, however the amplifier 54 may be configured as a different type of amplifier, such as a voltage amplifier, depending on the sensor output signal. For example, charge amplifier 54 may become a voltage amplifier when using a strain gauge as the shock sensor.

Analog Electronics Module 50

The analog electronics module 50 of FIG. 2 of the preferred embodiment will now be described in more detail in conjunction with FIGS. 2 and 3. The accelerometer 52 is designed to be a low-cost, off the shelf component. The illustrated embodiment of the accelerometer is constructed with "PZT"

(Lead zirconate titanate ($Pb[Zr_xTi_{1-x}]O_3$)), which is a ceramic perovskite material. Since the shock impulse imparted to the sensor is of a short duration, the AC signal produced by the sensor is a short pulse. Since a longer signal pulse duration is desired to facilitate the digital signal processing task (and avoid the need to sample the signal at an excessively fast rate), the accelerometer output is amplified, rectified, filtered, and scaled to give approximately a 5 millisecond unipolar pulse of 0.1 volts/g.

Amplifier 54, rectifier 56, RC filter 57, and amplifier/buffer 58 function as a modified peak signal detector which captures and holds the peak value of the short duration sensor impulse signals and allows the signal value to decay slowly according to the RC filter time constant value such that the subsequent digital signal processing electronics can accurately detect and count the events captured by the sensor.

The operation of the analog signal processing and interface circuit will now be described in further particulars in conjunction with FIG. 3. The accelerometer 52 outputs a charge proportional to the accelerations applied to it. This charge signal is converted to a voltage signal by the first amplifier 54 (U2A), which is then rectified by a diode 56 (D2) which is placed within the feedback loop of amplifier 54 to avoid the diode voltage drop. Diode 56 produces an output signal in response to positive going voltage signals corresponding to unidirectional shock impulses from the accelerometer sensor 52. The signal voltage from amplifier 54 and diode rectifier 56 charges a capacitor C3 of the RC filter 57, consisting of capacitor C3 and resistor R4, to the peak value of the signal voltage. C3 and R4 function as an analog RC circuit which responds to the positive going impulse signals from accelerometer 52 by reducing bandwidth, capturing and holding the peak signal voltage, and allowing the signal voltage to then slowly decay according the time constant determined by the product of R4 and C3. This result is that the shock-induced impulse signals from the sensor 52 are "stretched" and therefore can be accurately captured by the digital electronics module 60 without the need for high frequency clocking/sampling of the short duration sensor signal.

The stretched signal is then buffered and amplified by amplifier 58 (U2B) and sent to the analog-to-digital converter (ADC) 62 (FIG. 2) where the signal is digitized and sent to the Digital Signal Processor card 64 for processing and counting The diodes D1 and D3 provide input protection in the event that the accelerometer 52 is subjected to high g-forces (i.e. dropped). C1 and C2 are the gain setting capacitors. The charge sensitivity of the accelerometer is 5 pC/g±20%, where g is the gravitational constant 9.8 m/sec$^2$. This value is divided by the combination of C1 and C2 (48 pF) for a response of 104 mV/g. D2 performs the half-wave rectification and is kept in amplifier 54's feedback loop to prevent a diode drop in the signal. As explained above, C3 and R4 capture the short duration, peak sensor signal value and allow it to slowly decay (stretch) according to the time constant determined by the product of R4 times C3. The value of the RC time constant is set with consideration of the input signal cycle time and ADC (analog to digital converter) sample time. The utilization of the modified peak detector circuit with RC filter allows the sample time of the ADC to be reduced since the signal time has been stretched therefore improving ADC capture accuracy and facilitating accurate processing by the subsequent signal processing software. Amplifier 58 provides buffering of the RC filter circuitry to maintain integrity of the RC time constant and also provides for additional gain to be applied to the signal before it enters the ADC. The illustrated configuration uses a gain of three to create a total response of 312 mV/g.

Figure 3:
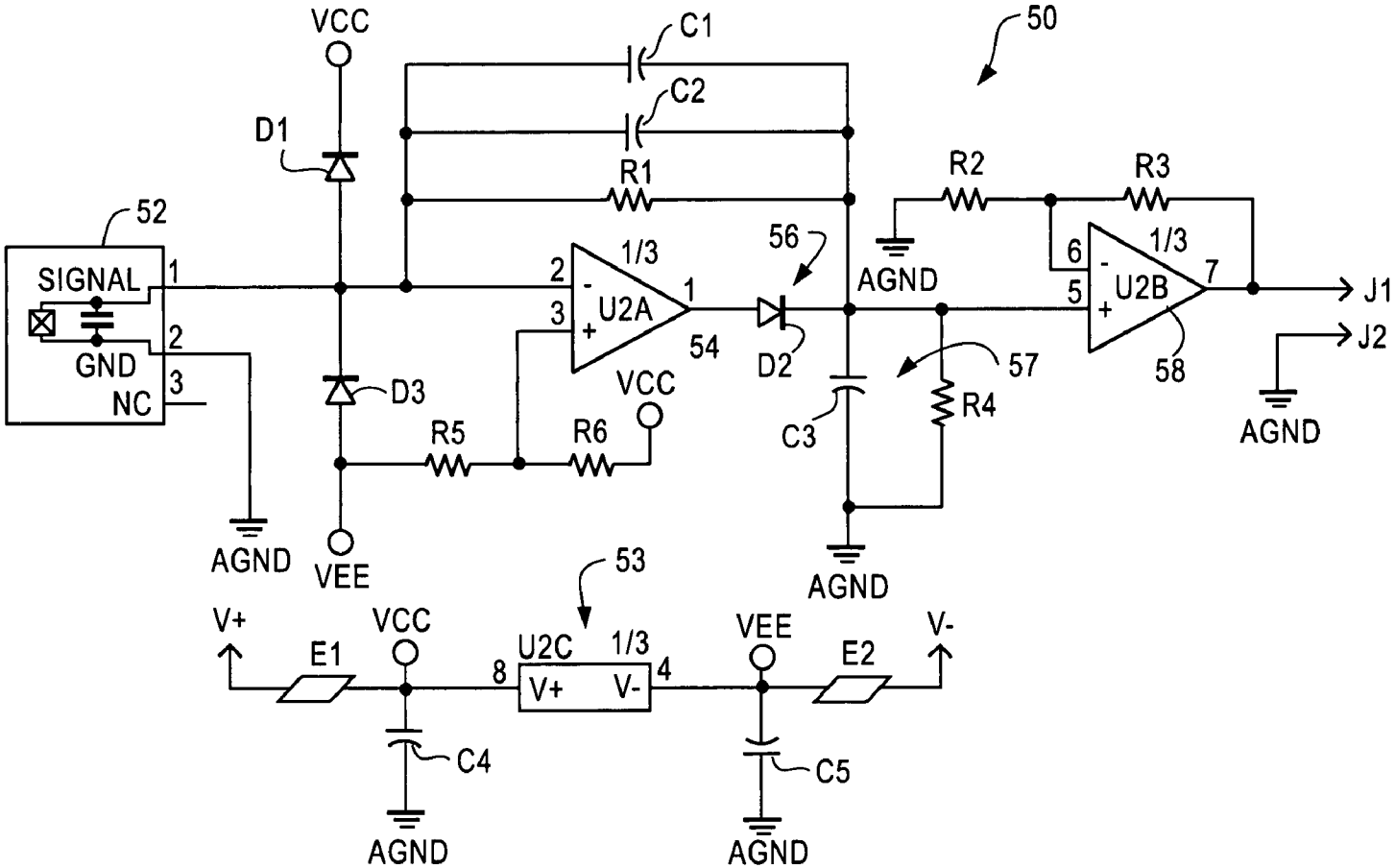
FIG. 3 is a circuit diagram of the analog electronics module of FIG. 2.

Also shown at the bottom of in FIG. 3 is the power supply circuit 53 supplying reference + and – voltages and VCC and VEE in the analog circuit 50.

Digital Electronics Module 60

The digital electronics module 60 of FIG. 2 includes the analog to digital converter (ADC) 62 receiving an analog accelerometer voltage signal from the analog electronics module 50 and producing a digital output signal. The module 60 also includes a logic gate (AND) 66 having as inputs the output of the ADC 62 and a trigger signal from the trigger 70 associated with the weapon and a digital signal processor 64 processing the output signal of the logic gate 66 as will be discussed below and registering counts for weapon firings in a counter 68.

The processor 72 in the DSP card 64 processes the signal from the analog to digital converter 62 to determine if the weapon has been fired. However, the weapon discharge will not be recorded by the DSP 64 based counter unless the signal is detected in conjunction with the weapon trigger being activated. This is accomplished by an "AND" function performed in the logic gate 66 of FIG. 2. The weapon station control operator enters the number of rounds in the ammunition box ready for the weapon to fire. If no number is entered, the rounds counter counts a negative number from zero. The weapon station identifies the type of weapon installed on the mount and uses that information to set the weapon cycle time in the software processing. The rounds counter therefore will not register a subsequent discharge event until the weapon is ready to fire again. The software digital signal processing also contains a function that thresholds the voltage received from the digitized analog accelerometer signal. The "AND" function, weapon cycle time windowing, and thresholding functions all serve to prevent false rounds counting.

Software Operation

The software operation of the rounds counter will be explained in conjunction with a state diagram illustrated in FIG. 4. The state diagram of FIG. 4 shows two separate software processes:

1) a first process 100 which reads the output of the ADC 62 at a rate of 2000 times per second to obtain the output of the rounds counter module 30, after digitization (digital value represented by signal "accRC", see FIG. 2); and 2) a process 102 by which the DSP microprocessor 72 in the DSP card 64 uses the accelerometer signal accRC, the trigger signal from the trigger 70, time, and voltage thresholds to register rounds firing (a count), count, and change the value in the counter 68 of FIG. 2.

Figure 4:
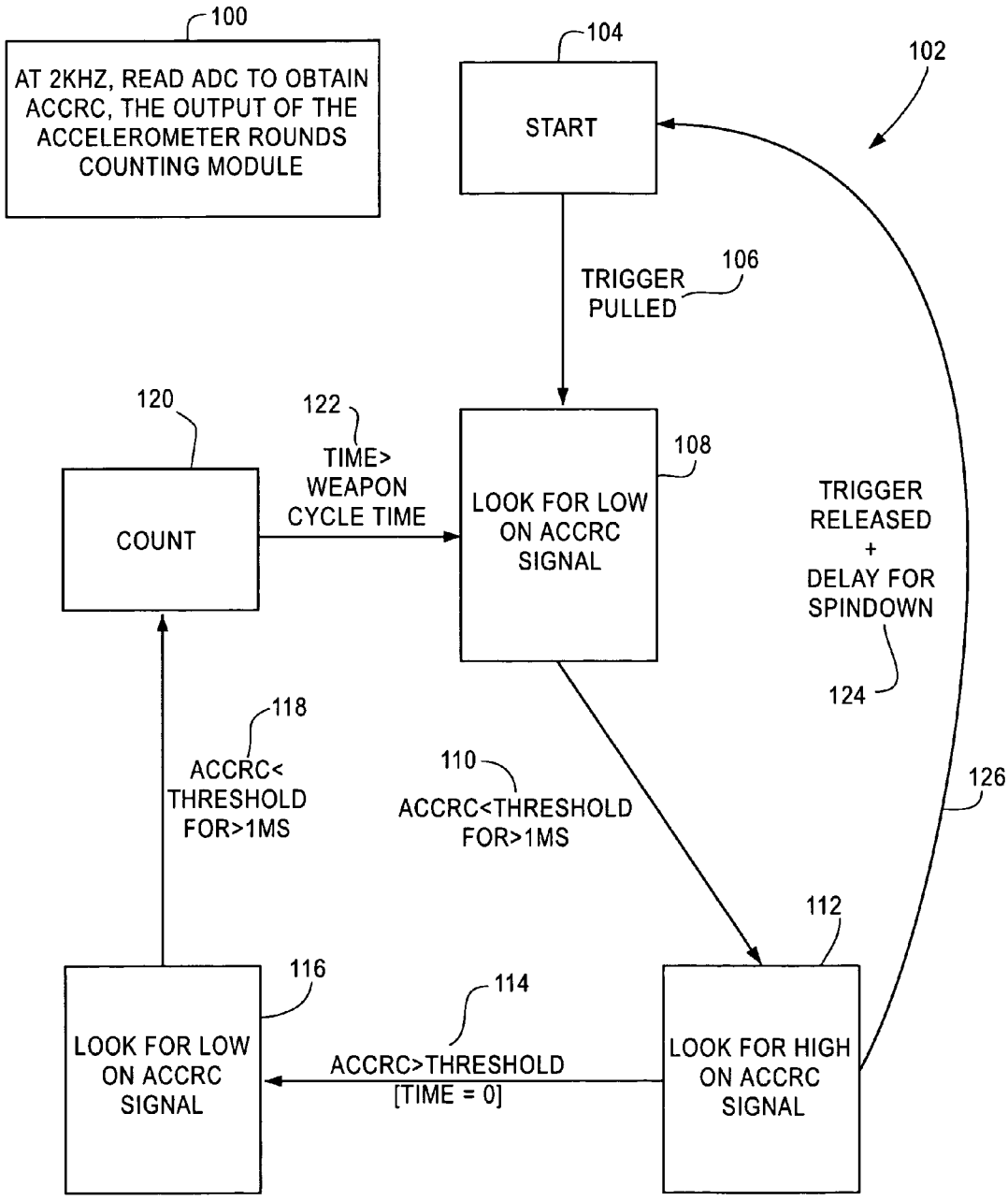
FIG. 4 is a state diagram showing the software operation of the rounds counter process implemented in the digital electronics module of FIG. 2.

The process 102 transitions from the states shown in the FIG. 4 depending on occurrence of certain events. The process 102 starts at a start state 104. The process changes from the start state 104 to the state 108 upon detection of a trigger pull signal 106. This is obtained from the trigger 70 of FIG. 2. When a trigger pull is detected, at state 108 the microprocessor looks for a low value on the output of the ADC 62 (accRC is low). When the accRC signal is less than a threshold V1 for greater than 1 millisecond, the process changes to state 112. At state 112, the DSP microprocessor looks for a high signal on the output of the ADC 62 (accRC is high), indicating high shock associated with firing of a round. When signal accRC goes high and is greater than a threshold V2, the process transitions to state 116. A timer is set to 0 and begins to measure the time elapsed since accRC went above the threshold V2. At state 116, the DSP microprocessor looks for a low signal on the output of the ADC 62 (accRC goes below the threshold V1). When accRC goes below the threshold V1 for a time greater than 1 millisecond, a count is registered at state 120. The process goes back to state 108 once the timer has exceeded a weapon cycle time value T, which will vary depending on the gun that is mounted to the mount. Thresholds V1 and V2 may also be gun-dependent.

If the gunner continues to pull the trigger and fire additional rounds, the transitions between states 108, 112, 116 and 120 will continue and additional counts will be registered in the counter. If, however, the gunner releases the trigger, the release of the trigger will be detected at state 112, and the process will revert back to the start state 104 as indicated by arrow 126. A delay period for "spindown" (cessation of firing rounds after release of trigger) is also required before the process goes back to state 104, with the spindown delay period being unique to different guns which are mounted to the mount. If, at state 112, the trigger is released, delay for spin down has elapsed and no high signal was detected, the process proceeds to state 104. If at state 112, the trigger is released but the signal accRC went high above the threshold V2 (due to a firing of at least one round), then the transition to states 116, 120 and 108 will occur and a count will be registered.

From the foregoing, it will be appreciated that we have disclosed method for counting rounds fired by a weapon 14 carried by a weapon mount 12, comprising the steps of:

mounting a shock-sensing sensor 52 (within the rounds counter module 30) to the weapon mount 12 in a location remote from the weapon (e.g., as shown in FIG. 1 and described above);

generating a signal by the sensor upon firing of the weapon due to shock imparted to the weapon mount (see FIG. 2);

processing the signal with electronic circuitry (FIG. 2) and responsively generating a count of the firing of the weapon.

In preferred embodiments the weapon mount 12 is adapted to receive and fire at least two different weapons. The rounds counter 30 provides counts for the weapon mount 12 for the firing of the at least two different weapons. The method may further comprise the steps of receiving a trigger signal indicating activation of a trigger associated with the weapon (see FIGS. 2 and 4) and using the trigger signal in conjunction with the signal generated by the sensor to generate a count of the firing of the weapon 14.

It will also be appreciated that a method for manufacturing a remotely operated weapon mount 12 adapted to receive and fire at least one weapon 14 is disclosed, comprising the steps of: a) determining at least one location on the weapon mount where shock loads due to the firing of the weapon are high relative to adjacent locations on the weapon mount (either experimentally, using a computer model of the mount and finite element analysis, or both); and b) mounting a rounds counter at the location determined in step a) (see FIGS. 1 and 1A), the rounds counter 30 comprising a sensor 52 of shocks due to firing of the weapon 14.

As noted in FIG. 1, in some embodiments the weapon mount will further include a pedestal 22, a gimbal 16 supported by the pedestal, and a weapon cradle 13 coupled to the gimbal 16, and wherein the location for mounting the rounds counter modules is a location on or within the pedestal 22.

From the foregoing, it will further be appreciated that a remotely operated weapon system has been disclosed including a weapon mount 12 (FIG. 1) adapted to receive and fire more than one type of weapon, the weapon mount including a pedestal 22, a gimbal 16 supported by the pedestal, and a weapon cradle 13 coupled to the gimbal, a sighting system (not shown) coupled to the weapon mount 12, operator controls for the weapon mount located remote from the weapon mount (not shown but known in the art, see the above-cited patents); and a rounds counter module 30 (FIGS. 1 and 1A) providing a common rounds counter for all of the types of weapons received and fired by the weapon mount, the rounds counter including a sensor component mounted to the mount in location remote from the weapon (see FIG. 1), the sensor component sensing shocks imparted to the mount due to firing of the weapon.

The rounds counter count (in counter 68) in the digital electronics module 60 is supplied to the remote operator unit. The display at the remote operator unit will ordinarily display the number of rounds remaining in the ammunition container, by counting down from the number of rounds which were loaded into the container.

While a number of exemplary aspects and embodiments have been discussed above, those of skill in the art will recognize that modifications, permutations, additions and sub-combinations thereof are also within the scope of the disclosure. It is therefore intended that the following appended claims and claims hereafter introduced are interpreted to include all such modifications, permutations, additions and sub-combinations as are within their true spirit and scope.

We claim:

1. A rounds counter for a weapon mount, comprising:

a) a sensor for sensing shock imparted to the weapon mount from the firing of a weapon held by the weapon mount and generating a sensor signal, wherein the sensor is mounted to the weapon mount in a location remote from the weapon, and b) electronic circuitry receiving the sensor signal and generating a count of each firing of the weapon, wherein the electronic circuitry comprises 1) analog circuitry coupled to the sensor and generating an output analog signal, and 2) digital circuitry comprising an analog to digital converter receiving the output analog signal and generating a digital rounds counter signal;

a logic element receiving a digital trigger signal from a trigger associated with the weapon mount and the digital rounds counter signal; and a processor and a memory storing program instructions, the instructions comprising instructions for:

i) detecting activation of the trigger from the digital trigger signal;

ii) detecting the digital rounds counter signal; and iii) generating a count of the number of times a weapon mounted to the weapon mount has been fired after detecting items i) and ii).

2. The rounds counter of claim 1, wherein the analog circuitry comprises:

a first amplifier receiving a signal from the sensor and outputting a voltage signal;

a rectifier rectifying the voltage signal output of the first amplifier;

a filter shaping the output of the signal from the amplifier; and a second amplifier coupled to the output of the filter providing amplification of the

3. The round counter of claim 2, wherein the first amplifier is a charge amplifier.

4. The rounds counter of claim 2, wherein the first amplifier is a voltage amplifier.

5. The rounds counter of claim 1, wherein the sensor comprises an accelerometer.

6. The rounds counter of claim 5, wherein the accelerometer is constructed of a ceramic peskovite material.

7. The rounds counter of claim 1, wherein the sensor comprises a strain gauge.

8. The rounds counter of claim 1, wherein the rounds counter is installed on a weapon mount adapted to receive and fire more than one type of weapon, the weapon mount comprising a pedestal, a gimbal supported by the pedestal, and a weapon cradle coupled to the gimbal, a sighting system coupled to the weapon mount; operator controls for the weapon mount located remote from the weapon mount; and wherein the rounds counter is a common rounds counter for all of the types of weapons received and fired by the weapon mount.

* * * * *